US007121027B1

(12) United States Patent
Sadallah

(10) Patent No.: US 7,121,027 B1
(45) Date of Patent: Oct. 17, 2006

(54) DECORATIVE TRASH RECEPTACLE SYSTEM

(76) Inventor: Marilyn Sadallah, 32-18 146th St., Flushing, NY (US) 11354

( * ) Notice: Subject to any disclaimer, the term of this patent is extended or adjusted under 35 U.S.C. 154(b) by 16 days.

(21) Appl. No.: 10/774,830

(22) Filed: Feb. 9, 2004

(51) Int. Cl.
*G09F 23/00* (2006.01)

(52) U.S. Cl. ..... 40/567; 40/606.05

(58) Field of Classification Search ..... 40/566, 40/567, 606.05, 606.06, 306, 661, 611.06, 40/720, 725, 324; 220/908, 665, 676
See application file for complete search history.

(56) References Cited

U.S. PATENT DOCUMENTS

| | | | | |
|---|---|---|---|---|
| 1,364,209 | A * | 1/1921 | Richardson | 232/1 R |
| 1,421,628 | A | 7/1922 | Watkins | |
| 1,424,520 | A * | 8/1922 | Richardson | 220/254.2 |
| 1,983,153 | A * | 12/1934 | Swerdloff | 40/312 |
| D104,059 | S | 4/1937 | Bensel | |
| D124,958 | S | 2/1941 | Hayden | |
| 2,300,473 | A | 11/1942 | Van Winkle | |
| D182,376 | S | 3/1958 | Moslo | |
| D214,288 | S | 5/1969 | Warnberg | |
| D268,059 | S | 2/1983 | Kracke | |
| 4,570,454 | A * | 2/1986 | Campbell | 62/457.3 |
| 4,928,412 | A * | 5/1990 | Nishiyama | 40/324 |
| 5,036,998 | A * | 8/1991 | Dunn | 220/23.87 |
| D329,514 | S | 9/1992 | Isaac | |
| D329,515 | S | 9/1992 | Isaac | |
| D363,583 | S | 10/1995 | Dimanche | |
| D394,930 | S | 6/1998 | Creske | |
| 6,905,043 | B1 * | 6/2005 | Zilberman | 220/665 |

OTHER PUBLICATIONS www.the littlevillageshoppe.com.
www.longhornranchgrill.com.
www.mybrushstroke.com.
www.littlej-artist.com.

* cited by examiner

*Primary Examiner*—Lesley D. Morris
(74) *Attorney, Agent, or Firm*—Michael I. Kroll

(57) ABSTRACT

An apparatus for an indoor-outdoor decorative trash receptacle system that allows a user to decorate or personalize a trash receptacle 12 or the like with permanent or interchangeable graphic images 14 or insignia. The system decorates a receptacle 12 in various forms including applying a graphic image directly onto the receptacle, applying a covering to the receptacle, and inserting a placard into a sleeve affixed to the receptacle. The graphic image 14 can be applied directly to the external wall 20 of the trash receptacle 12 using free form, stencil tracing, stamping or other painting techniques. This technique can also be produced onto an adhesive 24 backed vinyl placard or like material and then adhered to the exterior of the trash receptacle 12. Another system of the present invention utilizes a clear protective sleeve 26 that is affixed to the exterior of the receptacle 12. A placard 28 with a graphic image 14 is inserted into the clear sleeve 26 providing an artistic impression on the receptacle 12. The placard 28 is easily removed from the sleeve 26 and replaced with other placards to allow various designs to be displayed.

3 Claims, 12 Drawing Sheets

DECORATIVE TRASH RECEPTACLE SYSTEM

BACKGROUND OF THE INVENTION

1. Field of the Invention

The present invention relates generally to receptacles and, more specifically, to an indoor/outdoor decorative trash receptacle system that allows a user to decorate or personalize a trash receptacle or the like with permanent or interchangeable graphic images or insignia. The system of the present invention provides means to decorate a receptacle in various forms including applying a graphic image directly on the receptacle, applying a covering to the receptacle, and inserting a placard into a sleeve affixed to the receptacle. The decorating system of the present invention provides means to improve the appearance of an area by decorating a trash receptacle in an image that may blend into the background or provide information such as user name, address or provide personal greetings or depict other graphic images. The graphic image can be applied directly to the external wall of the trash receptacle using free form, stencil tracing, stamping or other painting techniques. This technique can also be produced onto an adhesive backed vinyl placard or like material and then adhered to the exterior of the trash receptacle. Another system of the present invention utilizes a clear protective sleeve that is affixed to the exterior of the receptacle. A placard with a graphic image is inserted into the clear sleeve providing an artistic impression on the receptacle. The placard is easily removed from the sleeve and replaced with other placards to allow various designs to be displayed.

2. Description of the Prior Art

There are other decorative devices designed as receptacles. Typical of these is U.S. Pat. No. Des. 104,059 issued to Bensel on Apr. 13, 1937.

Another patent was issued to Hayden on Feb. 4, 1941 as U.S. Pat. No. Des. 124,958. Yet another U.S. Pat. No. Des. 182,376 was issued to Moslo on Mar. 25, 1958 and still yet another was issued on May 27, 1969 to Warnberg as U.S. Pat. No. Des. 214,288.

Another patent was issued to Kracke on Feb. 22, 1983 as U.S. Pat. No. Des. 268,059. Yet another U.S. Pat. No. Des. 329,514 was issued to Isaac on Sep. 15, 1992. Another was issued to Isaac on Sep. 15, 1992 as U.S. Pat. No. Des. 329,515 and still yet another was issued on Oct. 24, 1995 to Dimanche as U.S. Pat. No. Des. 363,583.

Another patent was issued to Creske on Jun. 2, 1998 as U.S. Pat. No. Des. 394,930. Yet another U.S. Pat. No. 1,421,628 was issued to Watkins on Jul. 4, 1922. Another was issued to VanWinkle on Nov. 3, 1942 as U.S. Pat. No. 2,300,473.

U.S. Pat. No. Des. 104,059

Inventor: Duryea Bensel

Issued: Apr. 13, 1937

This United States patent discloses an ornamental design for a box or similar container as illustrated and described in the drawings of the patent.

U.S. Pat. No. Des. 124,958

Inventor: Samuel Hayden

Issued: Des. 124,958

This United States patent discloses an ornamental design for an ice container or similar article as illustrated and described in the drawings of the patent.

U.S. Pat. No. Des. 182,376

Inventor: Ernest P. Moslo

Issued: Des. 182,376

This United States patent discloses an ornamental design for a tumbler or similar article as illustrated and described in the drawings of the patent.

U.S. Pat. No. Des. 214,288

Inventor: Archie E. Warnberg

Issued: May 27, 1969

This United States patent discloses an ornamental design for a waste basket cover or similar article as illustrated and described in the drawings of the patent.

U.S. Pat. No. Des. 269,059

Inventor: Donald R. Kracke

Issued: Feb. 22, 1983

This United States patent discloses an ornamental design for a waste basket cover or similar article as illustrated and described in the drawings of the patent.

U.S. Pat. No. Des. 329,514

Inventor: Mimi Isaac

Issued: Sep. 15, 1992

This United States patent discloses an ornamental design for a refuse container cover or similar article as illustrated and described in the drawings of the patent.

U.S. Pat. No. Des. 329,515

Inventor: Mimi Isaac

Issued: Sep. 15, 1992

This United States patent discloses an ornamental design for a waste basket cover or similar article as illustrated and described in the drawings of the patent.

U.S. Pat. No. Des. 363,583

Inventor: Marlene G. Dimanche

Issued: Oct. 24, 1995

This United States patent discloses an ornamental design for a trash can decorator or similar article as illustrated and described in the drawings of the patent.

U.S. Pat. No. Des. 394,930

Inventor: Edward J. Creske

Issued: Jun. 2, 1998

This United States patent discloses an ornamental design for a waste basket cover or similar article as illustrated and described in the drawings of the patent.

U.S. Pat. No. 1,421,628

Inventor: Dwight E. Watkins

Issued: Jul. 4, 1922

A basket comprising a supporting frame, the sides thereof being formed of spaced rods, a waterproof receptacle detachably mounted within said frame and having the upper marginal edge thereof extending upwardly of the tops of said frame rods, a substantially U-shaped ring member adapted for detachable disposition over the upper marginal edge of said receptacle to overlap the same adjacent the tops of said frame rods, said ring member having transversely spaced apertures therein, and flexible fastening members for engaging through the apertures in said ring member and about said frame rods for detachably holding said ring member in assembled relation upon the frame and receptacle of said basket.

U.S. Pat. No. 2,300,473

Inventor: William R. Van Winkle

Issued: Nov. 3, 1942

An ornamental container arrangement including a sheet of corrugated paper board suitably joined end to end for tubular formation and content envelopment, said board having at least a liner layer interiorly of a corrugated layer, the corrugated layer being slit transverse to the axis of the tubular formation, the slit defined end portion of said layer and the liner portion secured thereto being turned inwardly at the slit portion, the liner layer at the slit constituting the hinge connection only, the inturned portion of the corrugated layer forming a retaining shoulder of appreciable width within the tubular formation and at the side wall thereof when adjacent liner portions are in contact, the opposite end of the board having its inner liner extended beyond the adjacent edge of the corrugated layer forming a tubular end extension therefor.

While these receptacles may be suitable for the purposes for which they were designed, they would not be as suitable for the purposes of the present invention, as hereinafter described.

SUMMARY OF THE PRESENT INVENTION

The present invention discloses an indoor-outdoor decorative trash receptacle system that allows a user to decorate or personalize a trash receptacle or the like with permanent or interchangeable graphic images or insignia. The system provides means to decorate a receptacle in various forms including applying a graphic image directly onto the receptacle, applying a covering to the receptacle, and inserting a placard into a sleeve affixed to the receptacle. The decorating system of the present invention provides means to improve the appearance of an area by decorating a trash receptacle in an image that may blend into the background or provide information such as user name, address or provide personal greetings or depict other graphic images. The graphic image can be applied directly to the external wall of the trash receptacle using free form, stencil tracing, stamping or other painting techniques. This technique can also be produced onto an adhesive backed vinyl placard or like material and then adhered to the exterior of the trash receptacle. Another system of the present invention utilizes a clear protective sleeve that is affixed to the exterior of the receptacle. A placard with a graphic image is inserted into the clear sleeve providing an artistic impression on the receptacle. The placard is easily removed from the sleeve and replaced with other placards to allow various designs to be displayed.

A primary object of the present invention is to provide means for decorating an indoor/outdoor trash receptacle.

Another object of the present invention is to provide a decorative trash receptacle comprised of indicia on the exterior surface of said trash receptacle.

Yet another object of the present invention is to provide a decorative trash receptacle having an image on the exterior surface of said trash receptacle.

Still yet another object of the present invention is to provide a decorative element for encompassing the exterior surface of said pail.

Another object of the present invention is to provide a decorative element for the exterior of a trash receptacle comprised of an image conforming substantially to the surrounding of said receptacle.

Yet another object of the present invention is to provide a decorative element wherein said decorative element has a protective element placed thereover.

Still yet another object of the present invention is to provide a decorative element wherein said protective element form an envelope for the insertion therein of the decorative element.

Additional objects of the present invention will appear as the description proceeds.

The present invention overcomes the shortcomings of the prior art by providing a decorative trash receptacle system that allows a user to decorate or personalize a trash receptacle or the like with permanent or interchangeable graphic images or insignia. The system of the present invention provides means to decorate a receptacle in various forms including applying a graphic image directly on the receptacle, applying a covering to the receptacle, and inserting a placard into a sleeve affixed to the receptacle. The decorating system of the present invention provides means to improve the appearance of an area by decorating a trash receptacle in an image that may blend into the background or provide information such as user name, address or provide personal greetings or depict other graphic images. The graphic image can be applied directly to the external wall of the trash receptacle using free form, stencil tracing, stamping or other painting techniques. This technique can also be produced onto an adhesive backed vinyl placard or like material and then adhered to the exterior of the trash receptacle. Another system of the present invention utilizes a clear protective sleeve that is affixed to the exterior of the receptacle. A placard with a graphic image is inserted into the clear sleeve providing an artistic impression on the receptacle. The placard is easily removed from the sleeve and replaced with other placards to allow various designs to be displayed.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
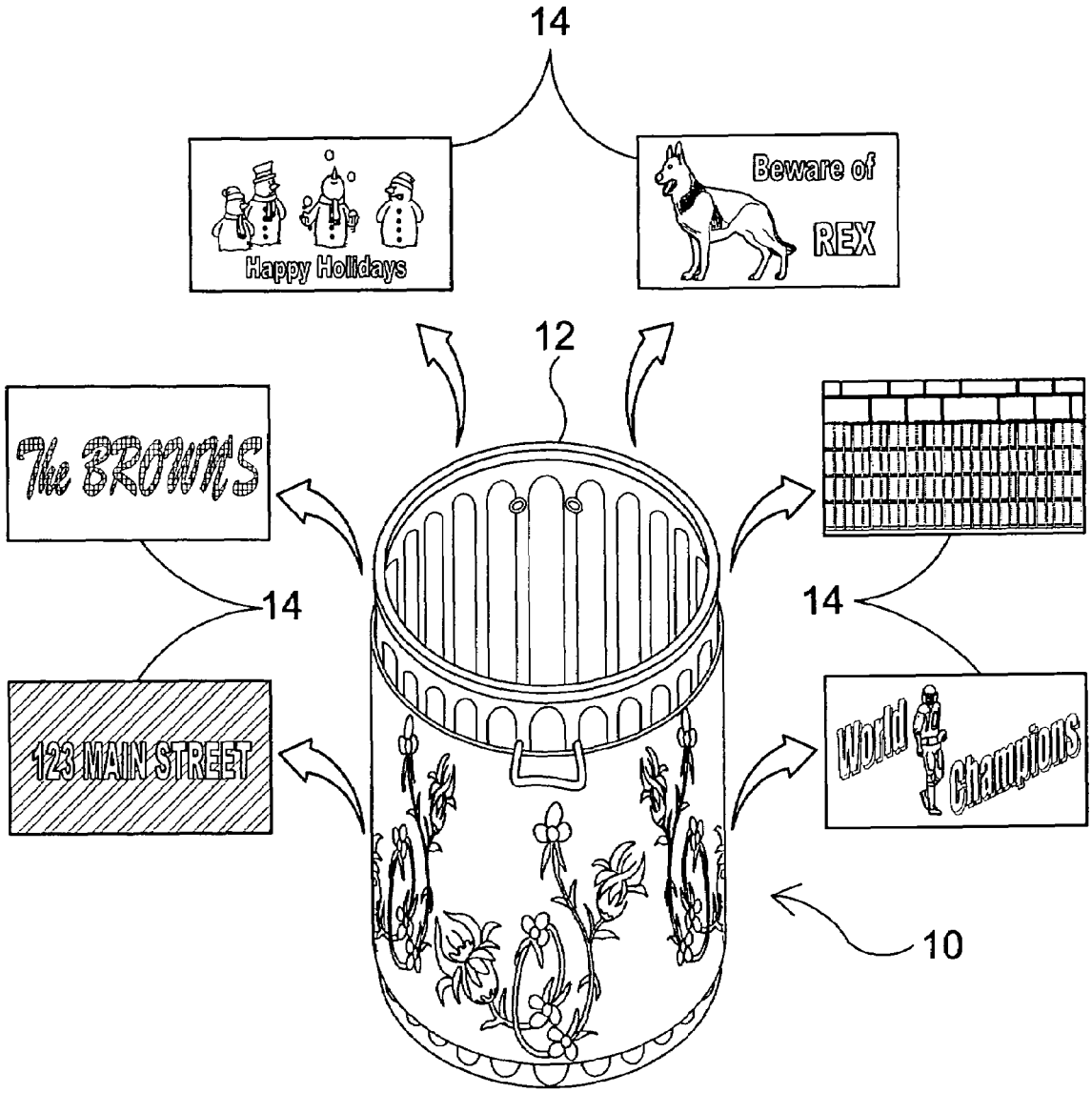
FIG. 1 is a perspective view of the present invention shown is the present invention decorative trash receptacle system.

With regard to reference numerals used, the following numbering is used throughout the drawings.

10 present invention
12 decorated trash receptacle
14 image
16 conventional trash receptacle
18 background image
20 wall
22 cover
24 adhesive
26 sleeve
28 placard
30 top cap
32 gasket
34 inner wall
36 outer wall
38 sleeve channel
40 apertures
42 handles

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is a perspective view of the present invention 10. Shown is the present invention 10 comprising a decorative trash receptacle system for indoor and outdoor use. The system allows a user to decorate or personalize a trash receptacle 12 or the like with permanent or interchangeable graphic images 14 or insignia. The system of the present invention 10 provides means to decorate a receptacle in various forms including applying a graphic image 14 directly on the receptacle 12, applying a covering to the receptacle, and inserting a placard in a sleeve affixed to the receptacle.

Figure 2:
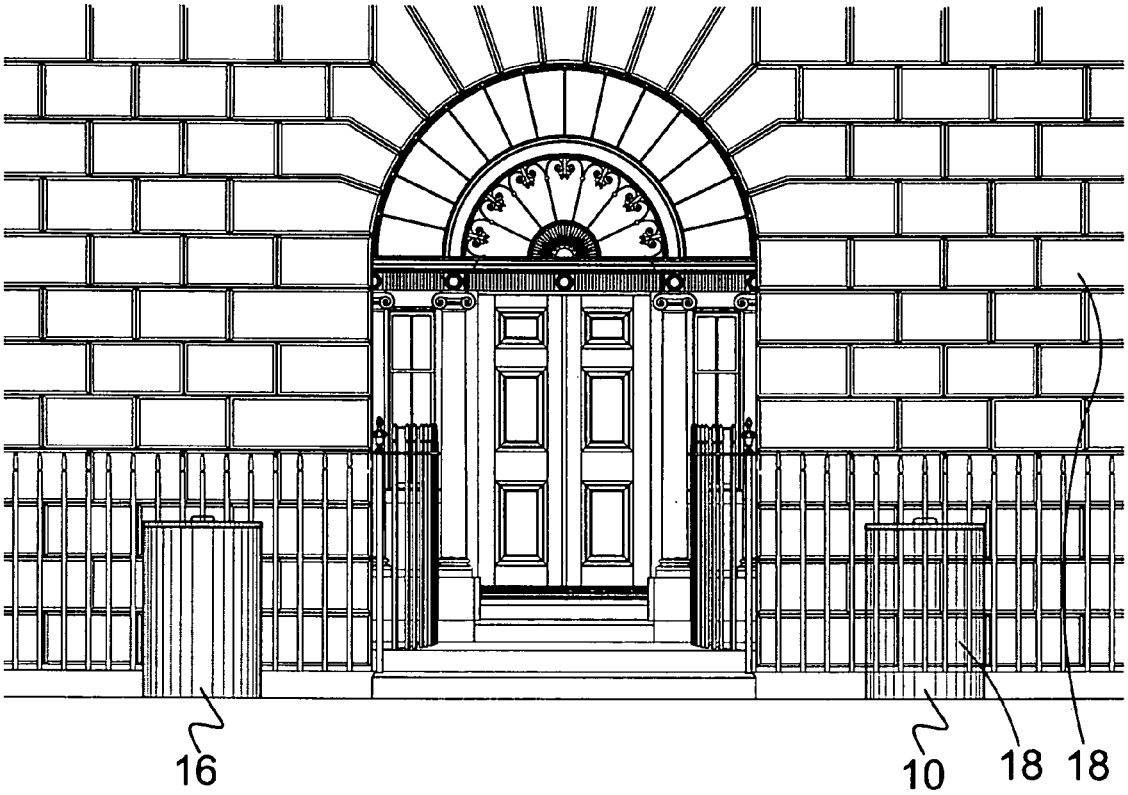
FIG. 2 is a perspective view of the present invention in use.

Turning to FIG. 2, shown therein is a perspective view of the present invention 10 in use. Shown is the present invention 10 comprising a decorative trash receptacle and a standard trash receptacle 16 for indoor and outdoor use. The receptacle 12 utilizing the decorating system is made obscure by applying a covering of the scenic background 18 whereas the standard receptacle 16 is highly visible and unsightly. The decorating system of the present invention 10 provides means to improve the appearance of an area by decorating a trash receptacle 12 in an image that blends into the background 18.

Figure 3:
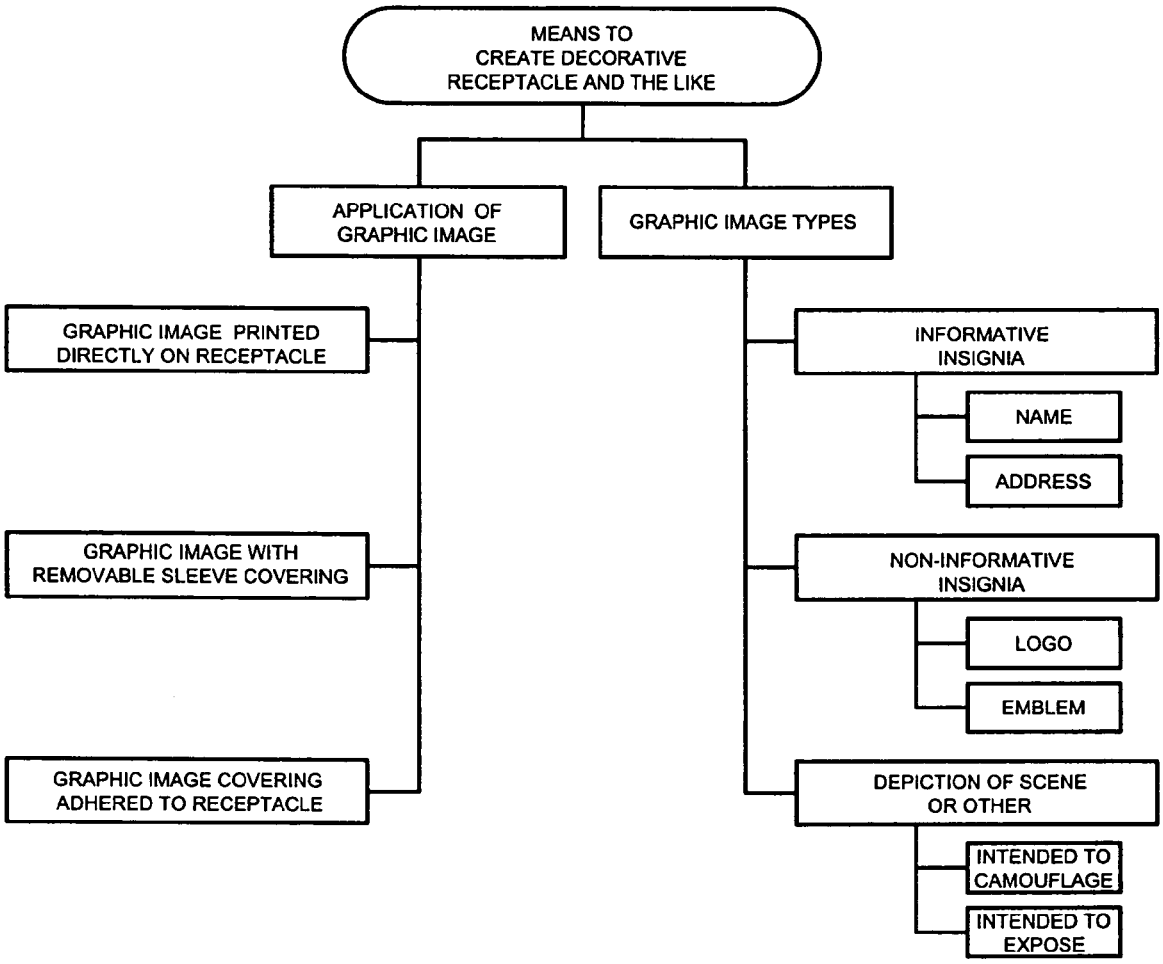
FIG. 3 is a block diagram of the present invention.

Turning to FIG. 3, shown therein is a block diagram of the present invention. The system of the present invention provides means to decorate a receptacle in various forms including applying a graphic image directly on the receptacle, applying a covering to the receptacle, and inserting a placard in a sleeve affixed to the receptacle. The graphic image can be used to provide information such as user name or address, provide personal greetings, or depict other graphic images.

Figure 4:
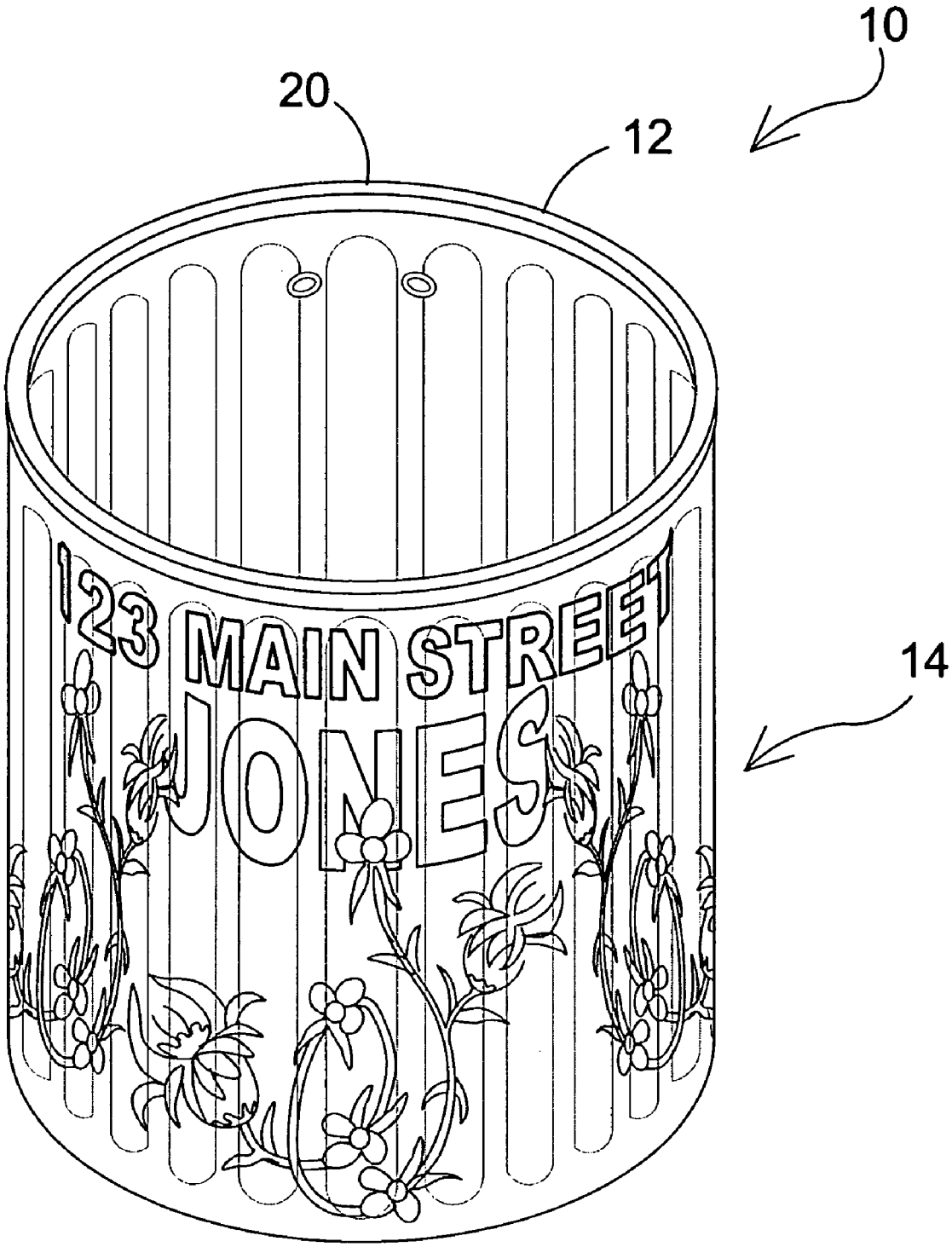
FIG. 4 is a perspective view of the present invention in use.

Turning to FIG. 4, shown therein is a perspective view of the present invention 10 in use. Depicted in FIG. 4 is an informative graphic image 14 of the users name and address on a trash receptacle 12. The graphic image 14 is applied directly to the external wall 20 of trash receptacle 12. The image 14 may be applied using free form, stencil tracing, stamping, or other painting technique.

Figure 5:
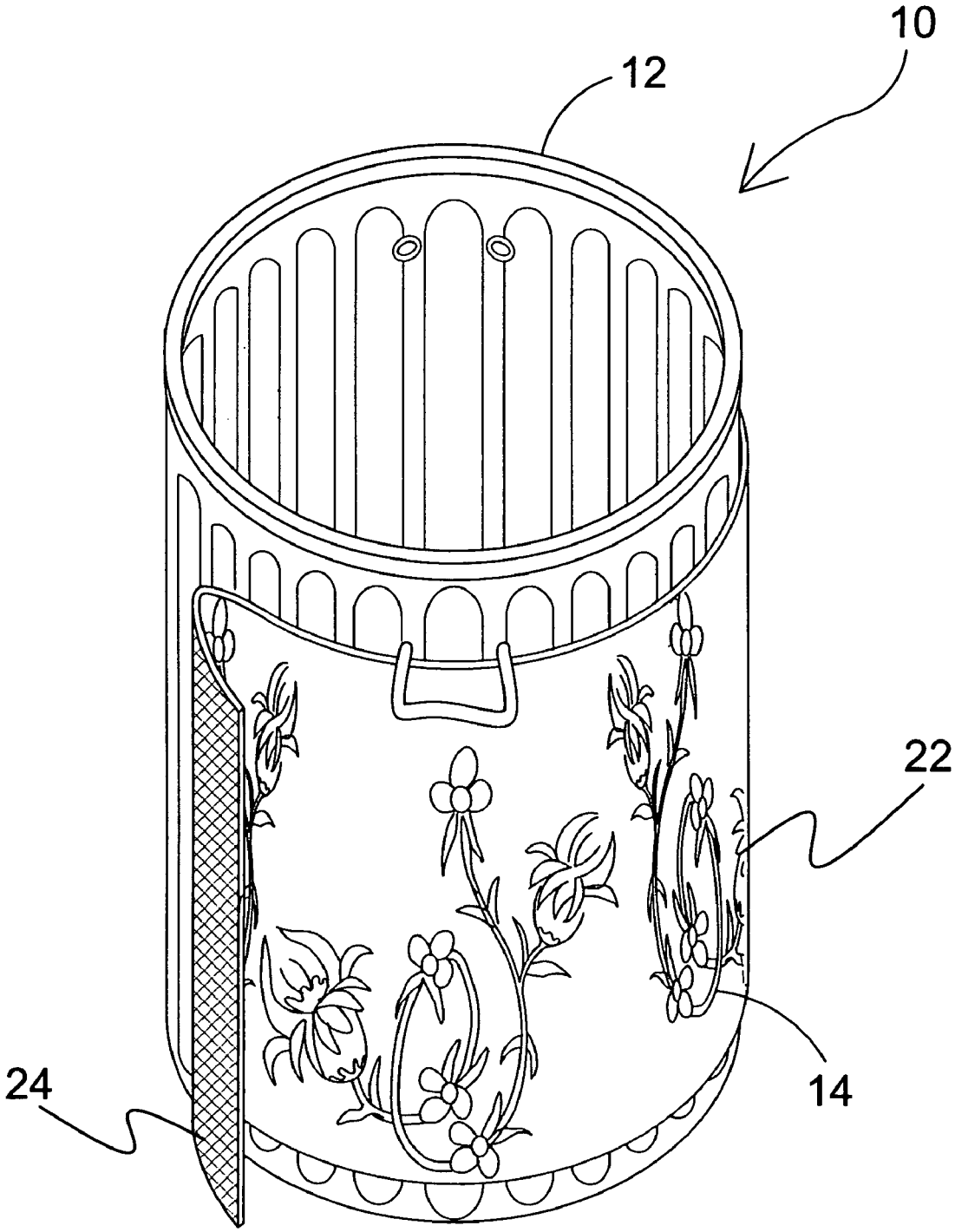
FIG. 5 is a perspective view of the present invention in use.

Turning to FIG. 5, shown therein is a perspective view of the present invention 10 in use. Depicted in FIG. 5 is a graphic image covering 22 of the user's preference being affixed to a trash receptacle 12. The graphic image 14 is painted or printed onto an adhesive backed 24 vinyl placard or like material and then adhered to the exterior of the trash receptacle. The graphic image covering 22 creates an artistic impression on the receptacle 12.

Figure 6:
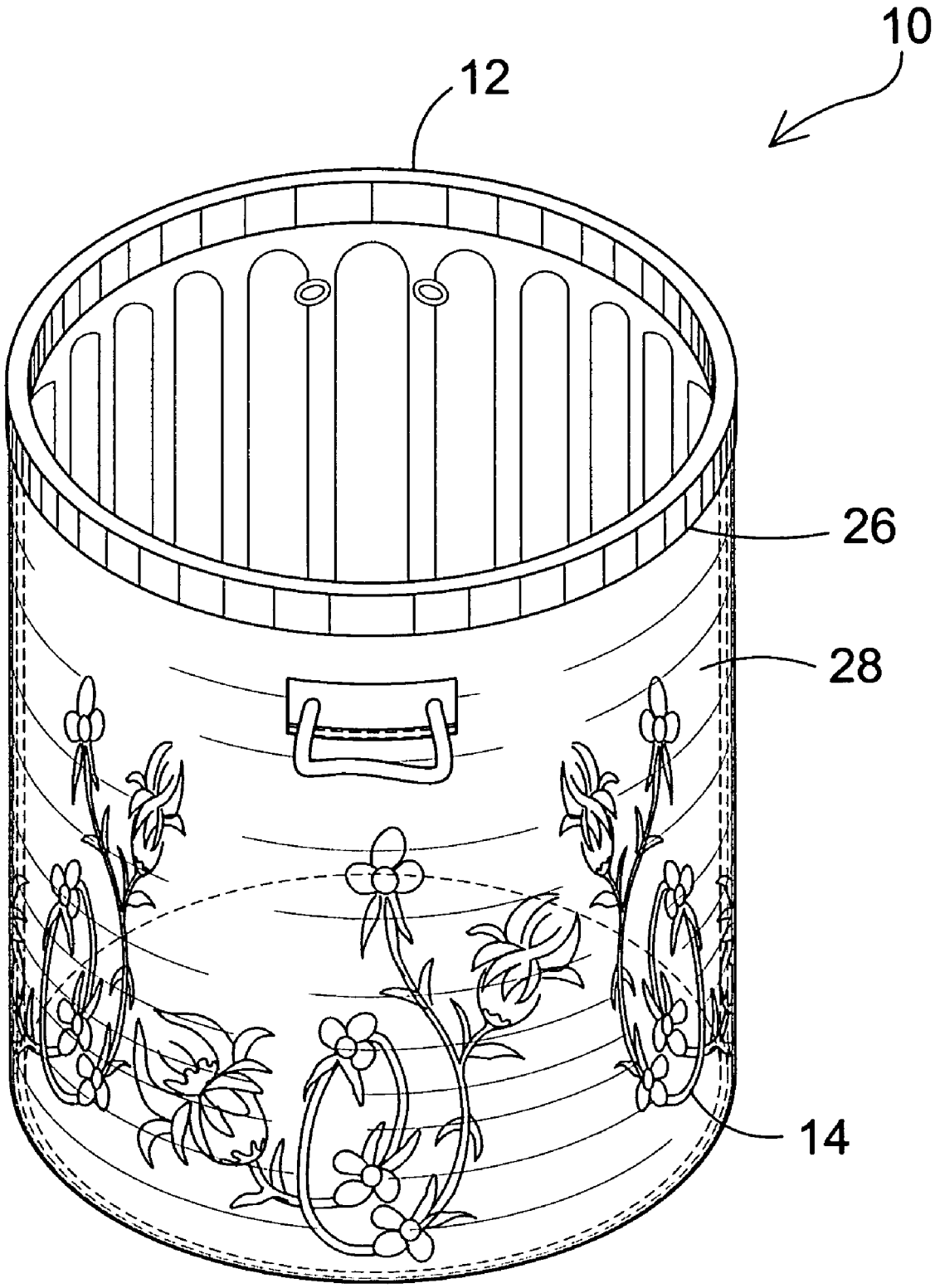
FIG. 6 is A perspective view of the present invention in use.

Turning to FIG. 6, shown therein is a perspective view of the present invention 10 in use. Depicted in FIG. 6 is the decorative trash receptacle system of the present invention 10 utilizing a clear protective sleeve 26 that is affixed to the exterior of the receptacle 12. A placard 28 with a graphic image 14 is inserted into the clear sleeve 26 providing an artistic impression on the receptacle 12. The placard 28 is easily removed from the sleeve 26 and replaced with other placards to allow various designs to be displayed.

Figure 7:
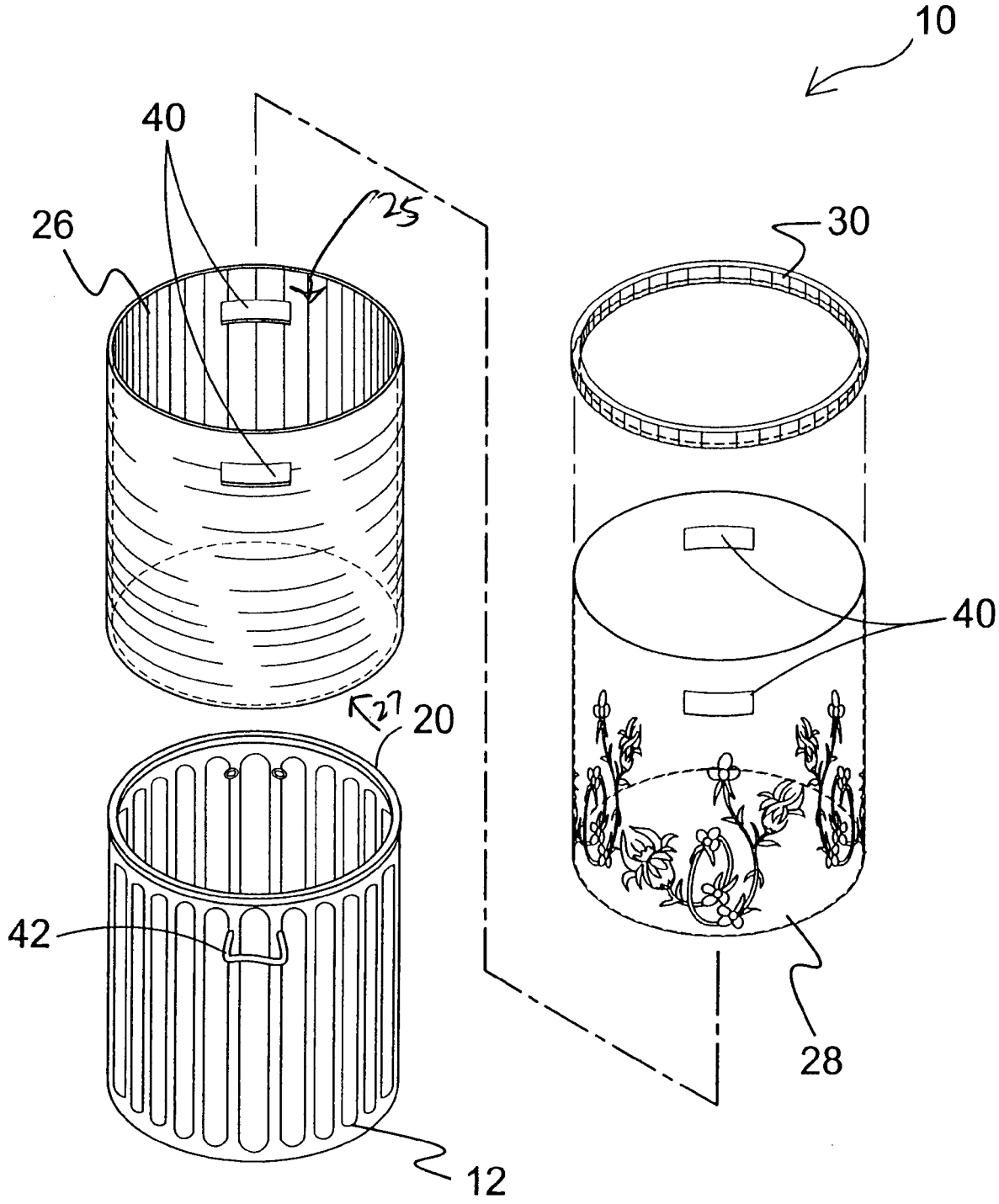
FIG. 7 is an exploded isometric view of the present.

Turning to FIG. 7, shown therein is an exploded isometric view of the present invention 10. Depicted in FIG. 7 is the indoor/outdoor decorative trash receptacle system of the present invention 10 utilizing a clear protective sleeve 26 that is affixed to the exterior of the receptacle 12. The clear protective sleeve 26 is cylindrical in shape and includes an open top side 25 and an open bottom side 27 to allow the clear protective sleeve 26 to be placed over a receptacle 12. The clear sleeve 26 is fitted over the receptacle 12 with the open end facing the top of the receptacle and the placard 28 with a graphic image thereon is inserted into the open end of clear sleeve and positioned to cover the receptacle exterior walls 20. Lastly, a top cap channel 30 or fitting is press-fitted over the top lip of the receptacle 12 and sleeve 26 securing the placard 28 and providing a watertight seal. Both the sleeve 26 and the placard 28 have apertures 40 for receiving the handles 42 of receptacle.

Figure 8:
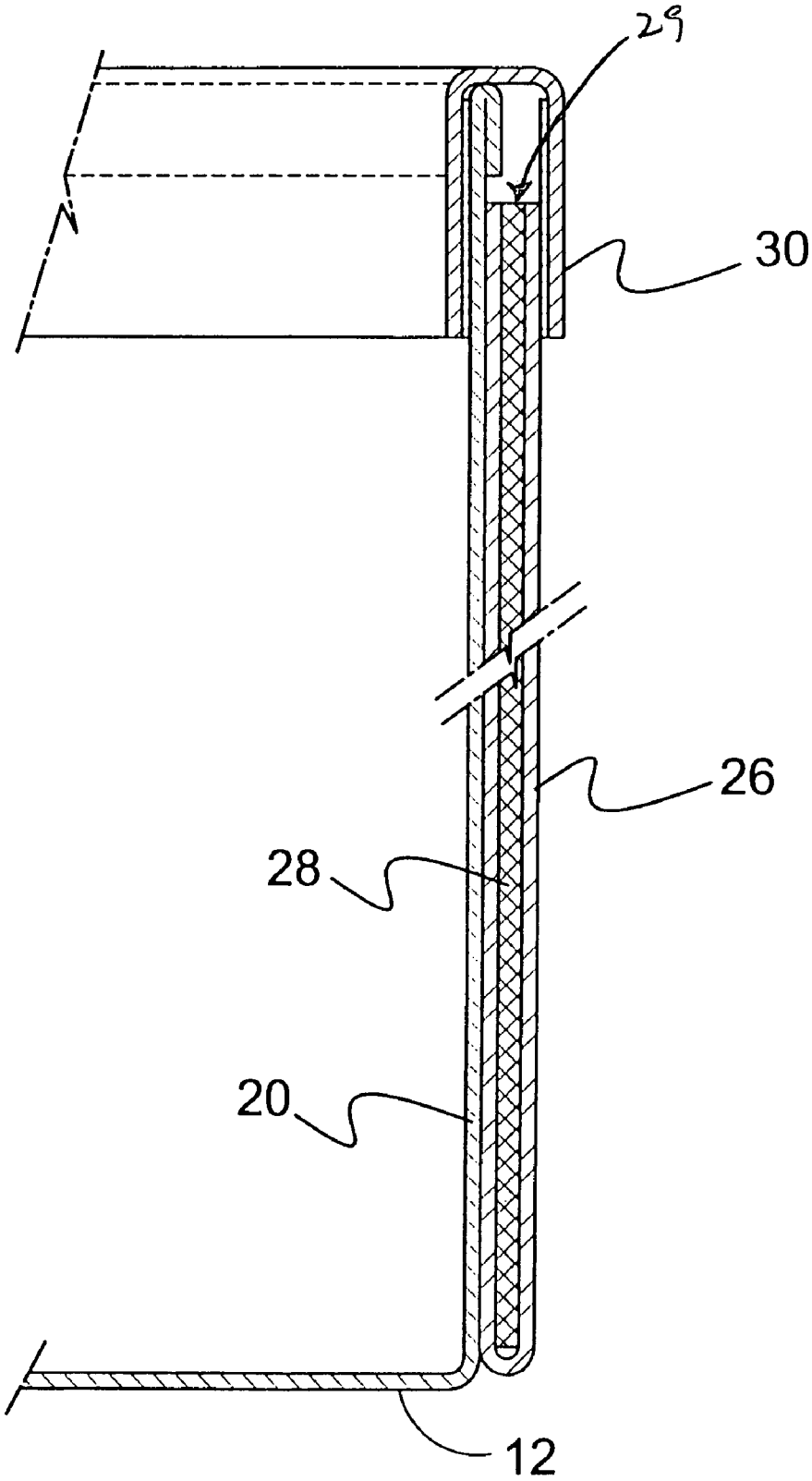
FIG. 8 is a sectional view of the present invention sleeve assembly.

Turning to FIG. 8, shown therein is a sectional view of the present invention sleeve assembly. Depicted in FIG. 8 is the indoor/outdoor decorative trash receptacle system of the present invention utilizing a clear protective sleeve 26 that is affixed to the exterior wall 20 of the of the receptacle 12. The clear sleeve 26 is fitted over the receptacle 12 with the open end 29 facing the top of the receptacle and the placard 28 with a graphic image thereon is inserted into the open end of clear sleeve and positioned to cover the receptacle exterior walls 20. A top cap channel 30 is press-fitted over the top lip of the receptacle 12 and sleeve 26 to secure and protect the placard 28.

Figure 9:
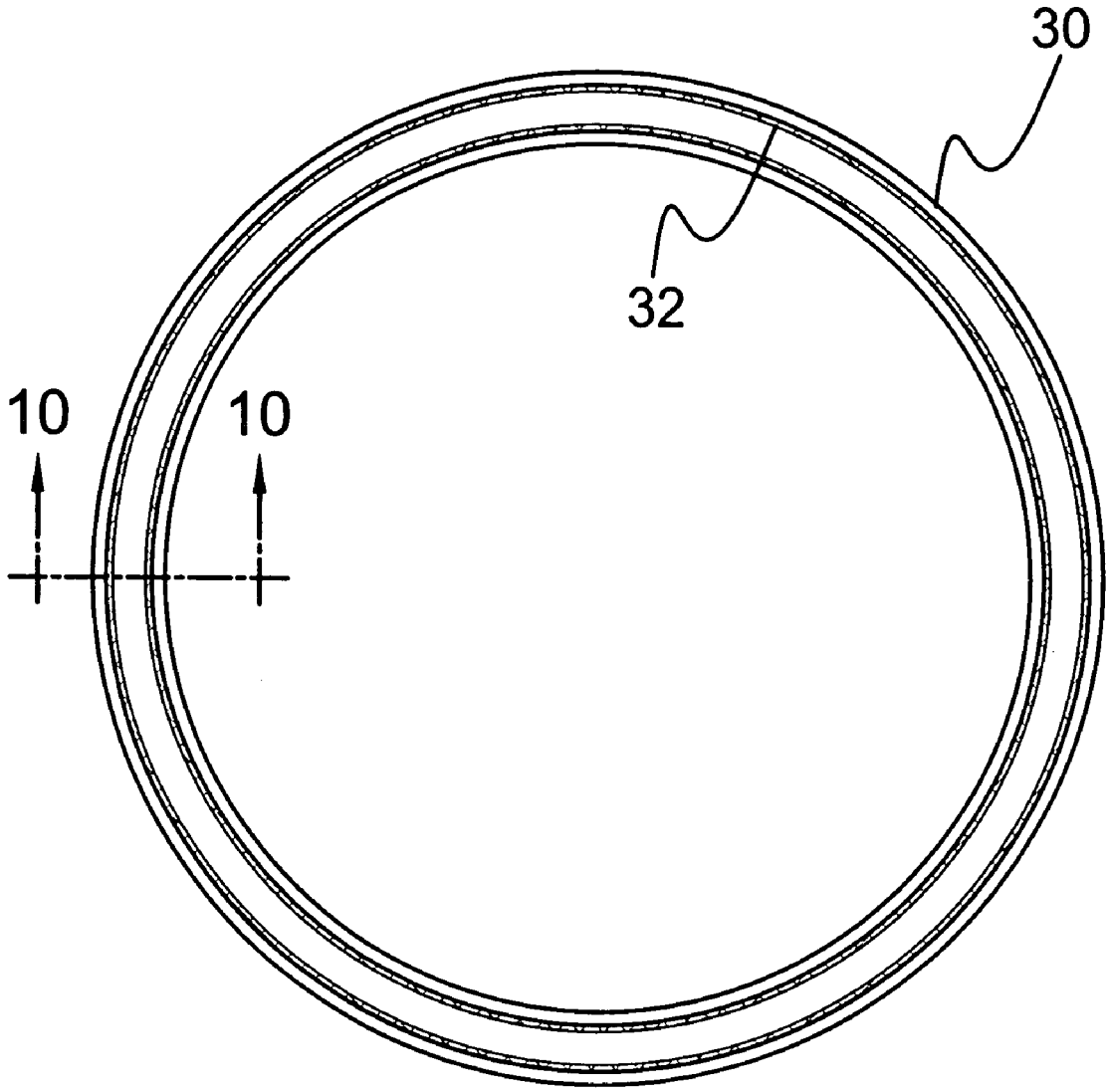
FIG. 9 is a top view of the present invention top cap channel.

Turning to FIG. 9, shown therein is a top view of the present invention top cap channel or fitting 30. Depicted in FIG. 9 is the present invention's decorative trash receptacle top cap channel 30. The top cap channel 30 with inner gasket 32 is press-fitted over the top lip of the receptacle and sleeve to secure and protect the placard from water and other elements. The top cap channel 30 is removed to access the placard for removal and/or replacement.

Figure 10:
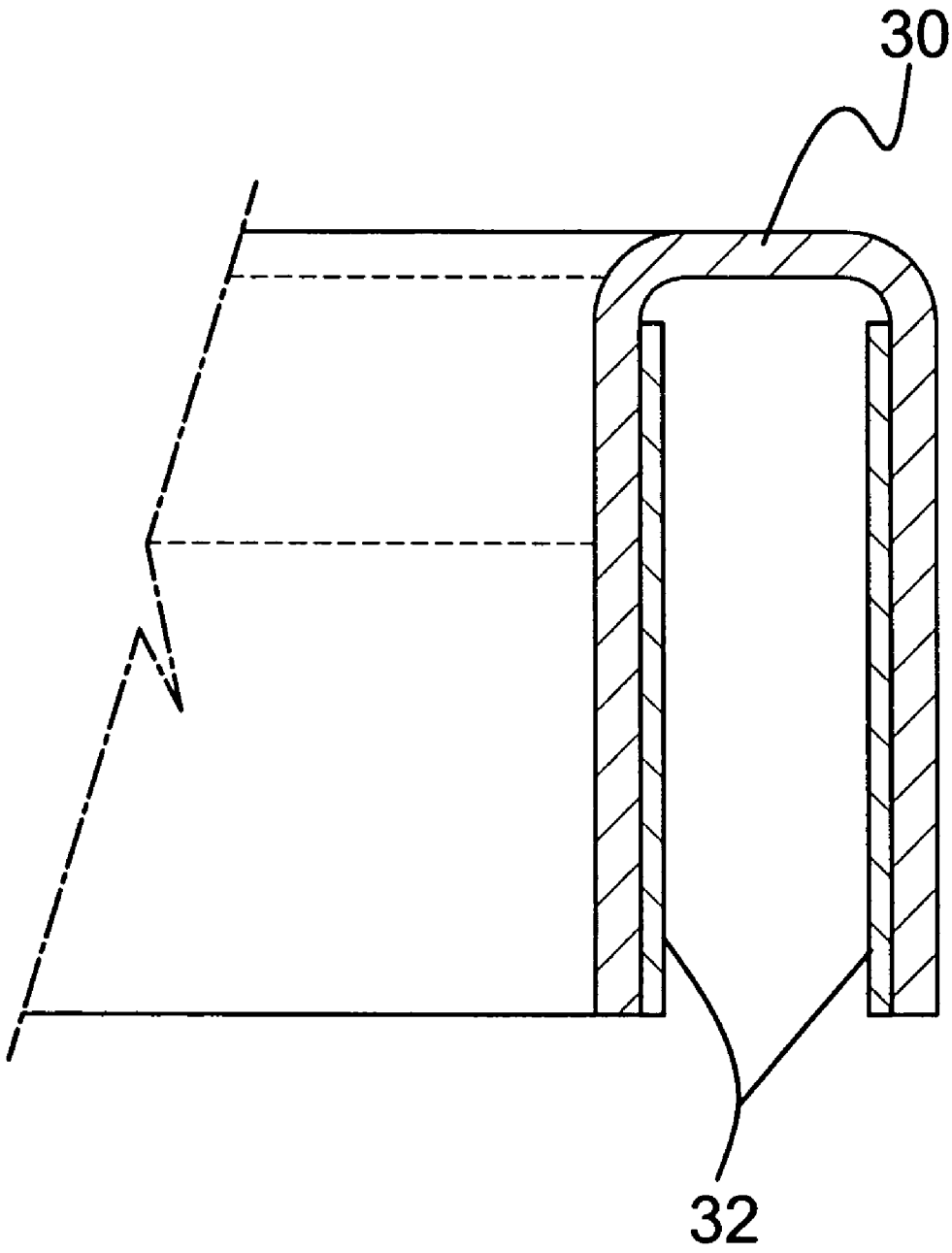
FIG. 10 is a sectional view of the present invention top cap channel.

Turning to FIG. 10, shown therein is a sectional view of the present invention top cap channel 30. Depicted in FIG. 10 is the present invention's indoor/outdoor decorative trash receptacle top cap channel 30. The top cap 30 is a U-shaped channel that is press fitted over the top lip of the receptacle and sleeve to secure the placard. The top cap 30 includes gasket material 32 on the inner walls of the channel to further protect and secure the interior when pressed onto the receptacle and sleeve.

Figure 11:
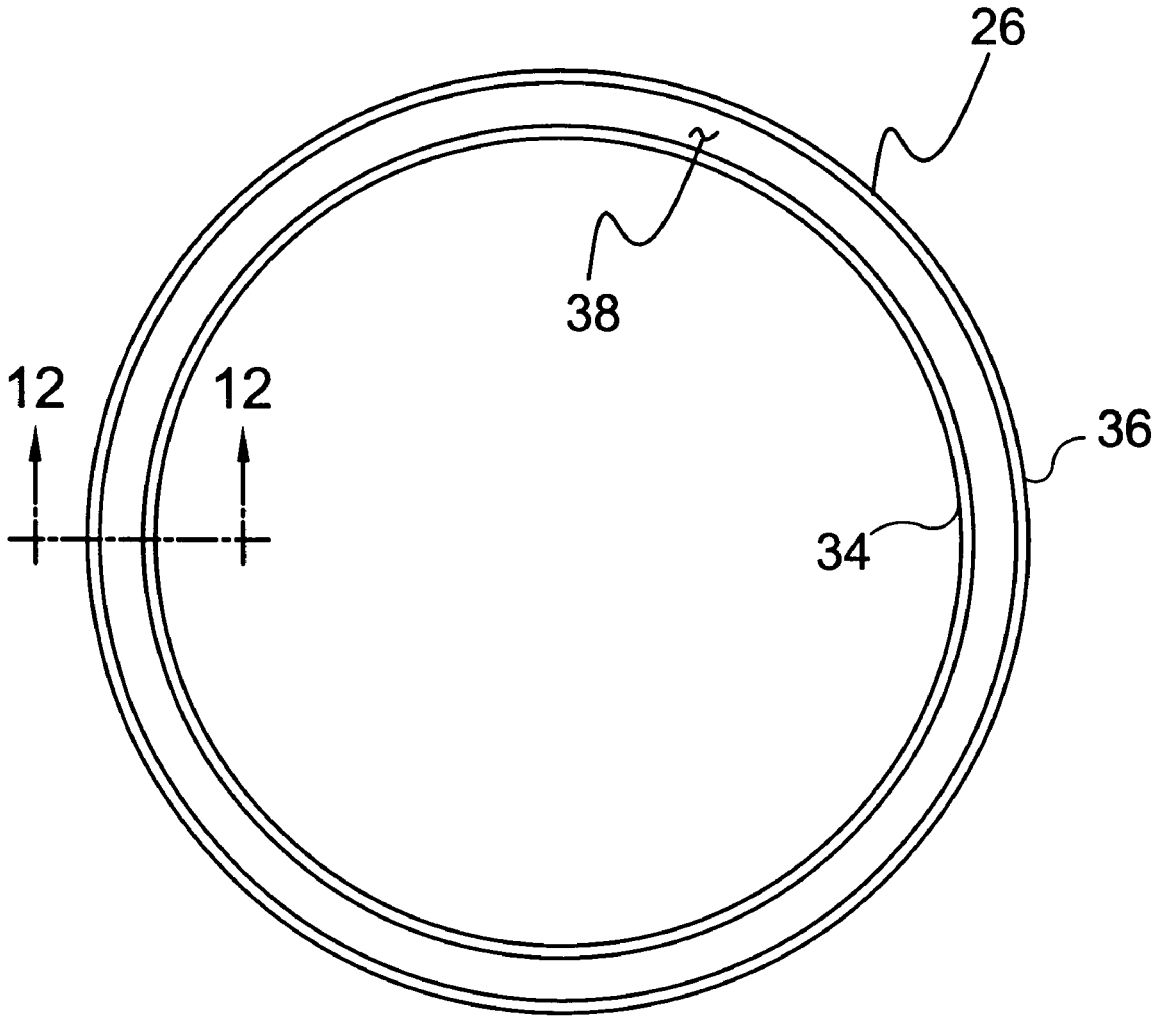
FIG. 11 is a top view of the present invention clear protective sleeve.

Turning to FIG. 11, shown therein is a top view of the present invention with clear protective sleeve 26. Depicted in FIG. 11 is the present invention's indoor/outdoor decorative trash receptacle clear protective sleeve 26. The sleeve 26 contains an inner wall 34 and outer wall 36 interconnected at one end creating a "U" channel 38 for inserting the placard. The sleeve 26 may be of various shapes and include apertures to accommodate the receptacle profile, lifting handles or other features.

Figure 12:
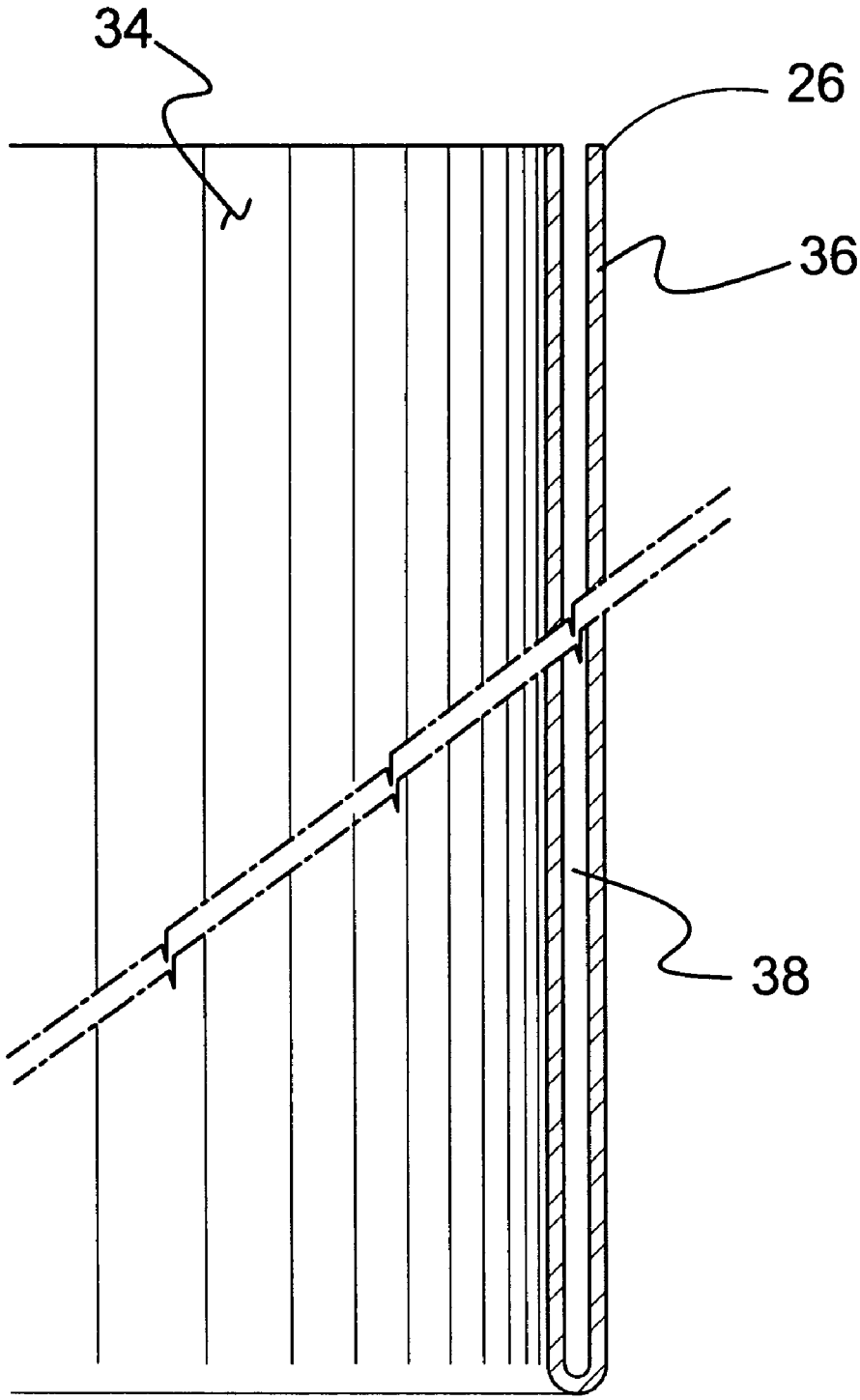
FIG. 12 is a sectional view of the present invention clear protective sleeve.

Turning to FIG. 12, shown therein is a sectional view of the present invention with clear protective sleeve 26. Depicted in FIG. 12 is the present invention's indoor/outdoor decorative trash receptacle clear protective sleeve 26. The sleeve 26 is fitted over the side walls of the receptacle with the open end of the sleeve facing up. The sleeve 26 contains an inner wall 34 and outer wall 36 interconnected at one end creating a U-channel 38 for inserting the placard.

I claim:

1. A system for applying a decorative image onto a trash receptacle, the trash receptacle having a wall with an exterior surface, the system comprising:

a) a protective sleeve being disposed around the exterior surface of the wall of the receptacle, said sleeve being shaped complementarily to the receptacle, said sleeve having top and bottom ends and having inner and outer cylindrical walls, said inner and outer walls being joined together at said bottom end so as to form a U-shaped cross-section between said inner and outer walls being open at said top end and having a channel formed between said walls, said sleeve having at least one aperture therein, said aperture for receiving a handle of the trash receptacle, said protective sleeve being open at the bottom end for receiving the trash receptacle therethrough, said bottom end being above a bottom of said trash receptacle;

b) a placard being removably disposed in said channel of said sleeve through said opening at said top end of said U-shaped cross-section said placard having openings corresponding to said at least one aperture in said protective sleeve for a handle of the trash receptacle to be accessible from outside of said protective sleeve; and, c) a removable, annular top cap, U-shaped in cross-section, disposed on said top end of said protective sleeve overlapping a top edge of said trash receptacle and both walls of said protective sleeve so as to form a watertight seal to permit the placard to be protected; and d) a decorative image being disposed on said front surface of said placard to permit the appearance of the trash receptacle to be enhanced.

2. The system of claim 1, further comprising a gasket being disposed between said top cap and said sleeve to form a watertight seal.

3. A trash receptacle system comprising:

a) a cylindrical trash receptacle having a closed bottom and a top opening, with handles on opposite, outer sides of said receptacle:

b) a transparent protective sleeve disposed around the outer sides of said receptacle, said sleeve extending from said top opening to just above said closed bottom, said sleeve having top and bottom ends and having inner and outer cylindrical walls being joined at the said bottom end so as to form an annular U-shaped cross-section between said inner and outer walls and being open at said top end of said U-shaped cross-section formed by said inner and outer walls forming a channel between said walls;

c) a cylindrical shaped placard removably disposed in said channel of said sleeve;

d) a removable, annular top cap, U-shaped in cross-section, overlapping a top edge of said trash receptacle and both walls of said protective sleeve so as to form a watertight seal to permit the placard to be protected;

e) said sleeve inner and outer walls and said placard having matching openings through which said handles extend for allowing said handles to be grasped from outside of said protective sleeve; and f) a decorative image being disposed on an outer surface of said placard visible through said transparent protective sleeve to permit the appearance of the trash receptacle to be enhanced.

* * * * *